US007458306B2

(12) United States Patent
Singh et al.

(10) Patent No.: US 7,458,306 B2
(45) Date of Patent: Dec. 2, 2008

(54) EXTERNAL MODULAR ARMOR ASSEMBLY

(75) Inventors: Paul P. Singh, Fremont, CA (US); Ronald E. Musante, Los Altos, CA (US); Brian H. Kariya, Los Gatos, CA (US); Anthony P. Lee, White Lake, MI (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 261 days.

(21) Appl. No.: 11/401,094

(22) Filed: Apr. 10, 2006

(65) Prior Publication Data

US 2007/0234895 A1 Oct. 11, 2007

(51) Int. Cl.
*F41H 5/02* (2006.01)

(52) U.S. Cl. ..... 89/36.02; 89/36.04; 89/36.07

(58) Field of Classification Search ..... 89/36.02, 89/36.04, 36.07, 36.08, 36.09, 36.13, 36.14, 89/36.15

See application file for complete search history.

(56) References Cited

U.S. PATENT DOCUMENTS

| | | | | | |
|---|---|---|---|---|---|
| 3,765,299 | A | * | 10/1973 | Pagano et al. | 89/36.08 |
| 4,036,104 | A | * | 7/1977 | Pagano et al. | 89/36.08 |
| 4,398,446 | A | * | 8/1983 | Pagano et al. | 89/36.08 |
| H129 | H | * | 9/1986 | Hansen | 89/36.04 |
| 5,033,357 | A | | 7/1991 | Seksaria et al. | |
| 5,370,034 | A | | 12/1994 | Turner et al. | |
| 5,421,238 | A | * | 6/1995 | Catalano | 89/36.02 |
| 5,499,568 | A | | 3/1996 | Turner | |
| 5,576,508 | A | * | 11/1996 | Korpi | 89/36.01 |
| 5,600,084 | A | | 2/1997 | Gonzalez | |
| 5,625,160 | A | | 4/1997 | Rudolf et al. | |
| 5,670,734 | A | * | 9/1997 | Middione et al. | 89/36.08 |
| 5,792,974 | A | | 8/1998 | Daqis et al. | |
| 5,822,936 | A | * | 10/1998 | Bateman | 52/281 |
| 6,009,789 | A | | 1/2000 | Lyons | |
| 6,041,689 | A | | 3/2000 | Lair et al. | |
| 6,047,626 | A | | 4/2000 | Lair et al. | |
| 6,082,240 | A | * | 7/2000 | Middione et al. | 89/36.08 |
| 6,345,563 | B1 | * | 2/2002 | Middione et al. | 89/36.17 |
| 6,474,213 | B1 | | 11/2002 | Walker et al. | |
| 2005/0257677 | A1 | * | 11/2005 | Ravid et al. | 89/36.02 |

* cited by examiner

*Primary Examiner*—Bret Hayes
(74) *Attorney, Agent, or Firm*—Patterson, Thuente, Skaar & Christensen, P.A.

(57) ABSTRACT

An interface includes a blast plate having plate structure, the plate structure being formed to substantially conform to a certain portion of an exterior margin of a hull of a certain vehicle and being semi-permanently mounted to the hull by mounting to certain mounting devices present on the exterior margin of the hull and having mounting structure for supportively mounting a standardized add-on device, the mounting structure being designed to facilitate the add-on device being readily mountable on and demountable from the plate structure, the plate structure having structural characteristics for acting to protect the hull from effects of a blast directed at the hull. A modular assembly and a blast plate are further included.

28 Claims, 6 Drawing Sheets

EXTERNAL MODULAR ARMOR ASSEMBLY

GOVERNMENT CONTRACT

The U.S. Government has a paid-up license in this invention and the right in limited circumstances to require the patent owner to license others on reasonable terms as provided for by the terms of Contract No. DAAE07-00-M-M051 awarded by the Department of the Army.

TECHNICAL FIELD

The present invention relates to fighting vehicles. More particularly, the present invention relates to devices that are added on to the exterior of the vehicle hull.

BACKGROUND OF THE INVENTION

With the threat of improvised explosive devices and similar explosives encountered in various combat situations throughout the world, combat and tactical vehicles are presently only providing limited protection for the troops using the vehicles. The solution to this problem is add-on armor kits. The add-on armor kits are required to improve the ballistic protection of the vehicle occupants. The known method to increase armor protection is to mount the add-on armor kits directly to the exterior of the vehicle. To effect this, the exterior of the vehicles is modified by welding or installing add-on armor mounting provisions. Mounting the add-on armor kits directly to the vehicle limits the add-on armor packages to the exact configuration of the vehicle mounting devices. Such add-on armor kits are disadvantageously limited to use in a specific location on the specific type of vehicle for which the kit is designed.

The add-on armor kit for U.S. and foreign vehicles is usually mounted to the vehicle with welded studs on the exterior of the armor vehicle. Vehicles such as the U.S. Bradley Fighting Vehicle use slide rails which are mounted to the bolt pattern on the exterior of the vehicle. This add-on armor provides the base vehicle with improved ballistic protection. However, a specific type of add-on armor kit or add-on armor modules must be designed solely to interface with the particular vehicle mounting provision. As noted above, these kits are not interchangeable with other kits which have different mounting provisions. As depicted in prior FIG. 1, presently virtually all combat vehicles with add-on armor kits have the armor kit mounted directly to the vehicles structure using a stand-off weld stud, bolt-on spacer, or guard rails. This limits the armor application to the specific add-on armor kit designed for the specific mounting provision.

Additionally, it is noted that the add-on armor kits for certain vehicles have significant spaces between various armor modules that make up the kit. Such spaces reduce the amount of protection available to the occupants of the vehicle. Further, the prior art add-on armor kits expose the means of mounting the various modules of the armor kit to the vehicle to the blast effect of munitions directed at the vehicle. And, there is no electrical communication provided by the mounting means between adjacent modules.

Accordingly, there is a need for improved add-on armor for today's fighting vehicles.

SUMMARY OF THE INVENTION

The present invention is a modular assembly including both a blast plate subassembly and an add-on module subassembly. The blast plate subassembly is mounted directly to the vehicle and functions as an interface or an intermediate plate, providing mountings for the add-on module subassemblies. The blast plate subassembly mitigates the blast effect from add-on reactive armor subassembly, such that vehicle hull deformation is minimized. Further, the blast plate subassembly provides additional ballistic protection against kinetic energy projectiles such as, small arms, heavy machine gun, and heavy type threats.

The blast plate subassembly may be made of different types of material, such as metallic (steel, aluminum, titanium, etc.) or composite (fiber reinforced plastic or fiber reinforced glass) material. The blast plate subassembly has mounting locations designed to mate to the existing vehicle structure mounting means. Further, the blast plate subassembly provides for additional mounting provisions for non-armor items to be carried on the vehicle such as, Basic Issue Items (BIIs), troop gear ("A" and "B" bags), and vehicle tools.

The module subassemblies of the present invention provide for ergonomic installation of the individual modules with a unique self-locating load bearing pin-tool-bracket connecting devices. Where multiple rows of modular subassemblies are utilized, higher row modular subassemblies interlock with the lower row modular subassemblies to provide weight support during installation and also to provide armor protection over the lower row mounting hardware.

The unique interface of the upper and lower rows of modular subassemblies provides for electrical connection as required for EM modules and other needs. The module subassemblies of the present invention provide for module adjustment to near zero gap conditions between the adjacent module subassemblies in order to maximize protection at module seams. The module subassemblies of the present invention are readily removable and installable, thereby allowing for readily tailoring the module installation formation need, such as installing modules where you need them or installing heavier or lighter modules in accordance with the anticipated threat. Further the standardized module subassemblies may be readily used on a variety of vehicle types.

The present invention is an interface that includes a blast plate having plate structure, the plate structure being formed to substantially conform to a certain portion of an exterior margin of a hull of a certain vehicle and being semi-permanently mounted to the hull by mounting to certain mounting devices present on the exterior margin of the hull and having mounting means for supportively mounting a standardized add-on device, the mounting means being designed to facilitate the add-on device being readily mountable on and demountable from the plate structure, the plate structure having structural characteristics for acting to protect the hull from affects of a blast directed at the hull. The present invention is further a modular assembly having an interface and add-on devices.

DETAILED DESCRIPTION OF THE DRAWINGS

The modular assembly of the present invention is shown generally at 10 in the figures. The modular assembly 10 includes two subassemblies; the blast plate 12 and the add-on module 14.

Figure 1:
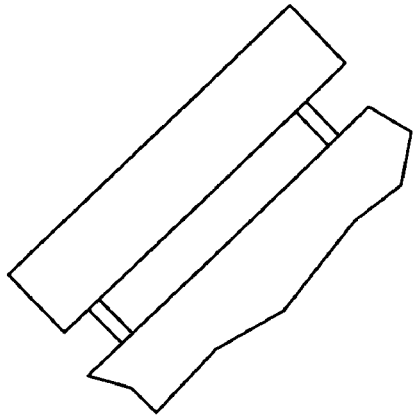
Fig. 1 Prior Art
FIG. 1 is a side elevational view of a prior art add-on armor kit mounted to vehicle structure.
Figure 3A:
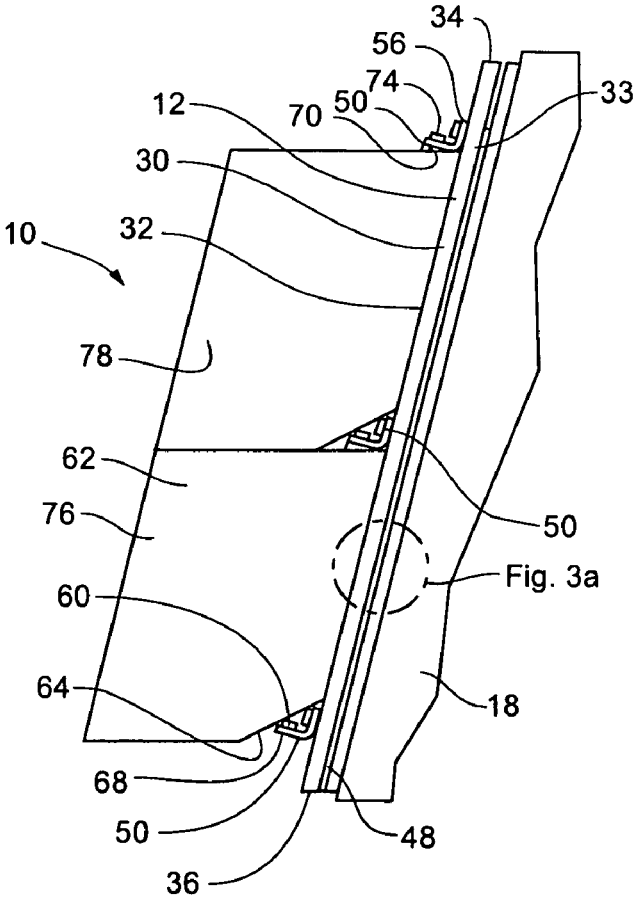
FIG. 3*a* is a side elevational view of the modular assembly mounted to a vehicle hull.
Figure 2:
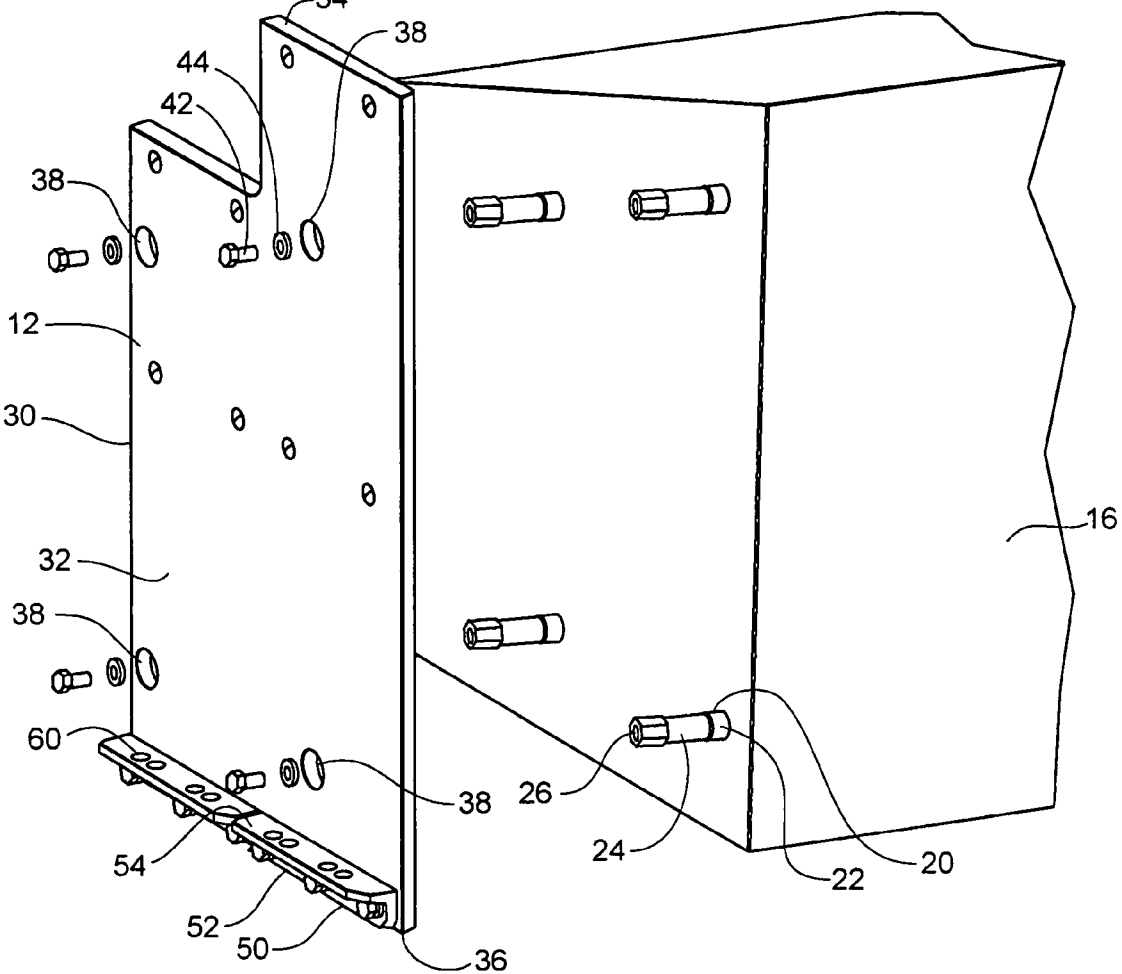
FIG. 2 is a perspective exploded view of the blast plate subassembly and a typical vehicle hull.

A portion of a fighting vehicle 16 is depicted in FIGS. 2 and 3*a*. The vehicle 16 includes a vehicle hull 18 which may include vehicle armor as depicted in FIG. 3*a*.

Figure 12:
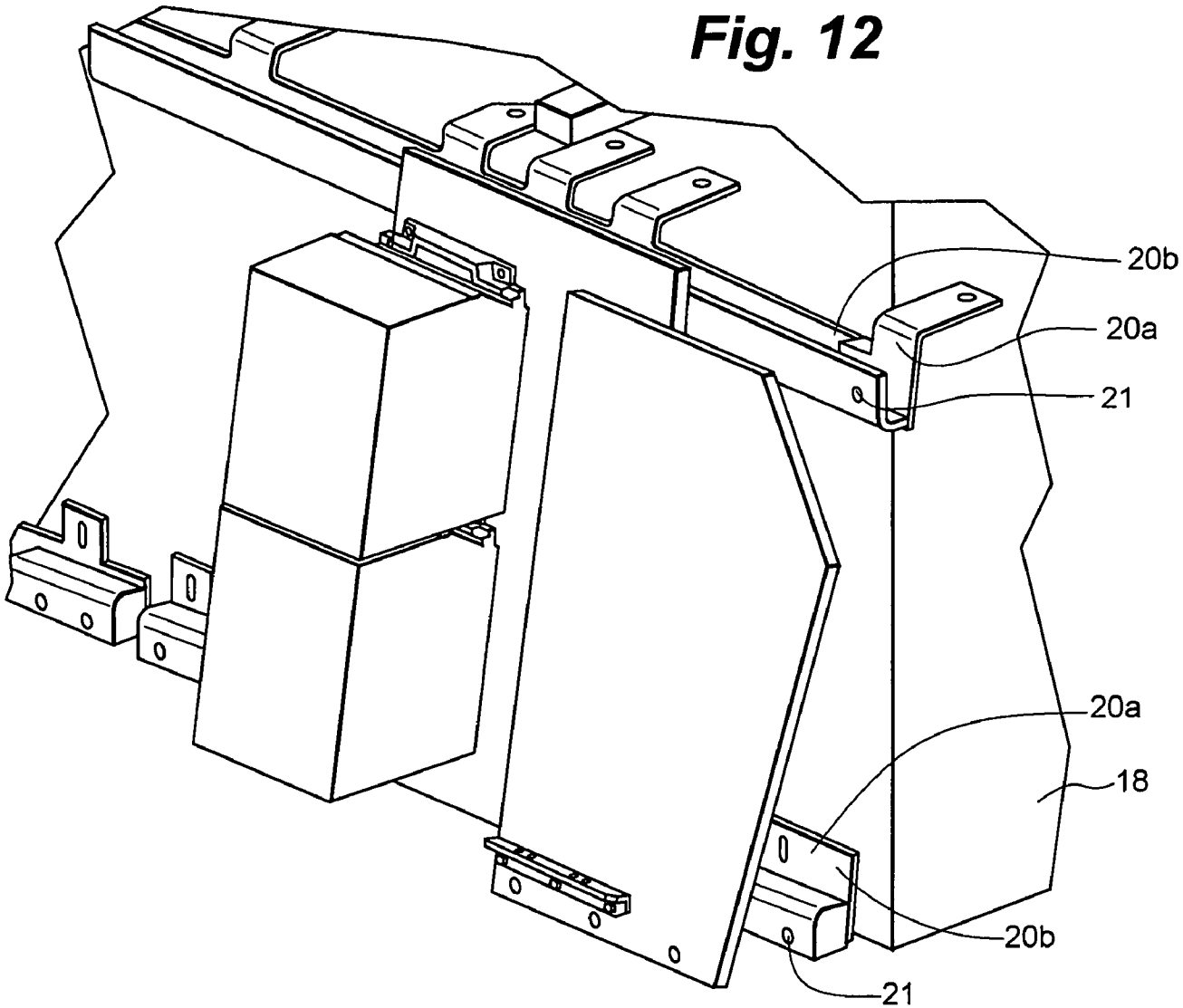
FIG. 12 is a perspective view of the modular assembly of the present invention with a rail mounting system on the vehicle.

A vehicle mounting array 20 is provided for mounting various structures exteriorly to the vehicle 16 in a known pattern on the vehicle hull 18. A typical vehicle interface array 20 includes a base 22 and an outward directed stud 24. A longitudinal blind threaded bore 26 is provided in the end margin of the stud 24. It is understood that the modular assembly 10 of the present invention is made readily compatible with other means of vehicle interfaces such as a rail mounting array 20*a*. The alternative rail mounting array 20*a* is depicted in FIG. 12. The alternative rail mounting array 20*a* includes parallel rails 20*b* having spaced apart bores 21 defined therein in a selected pattern.

Figure 11:
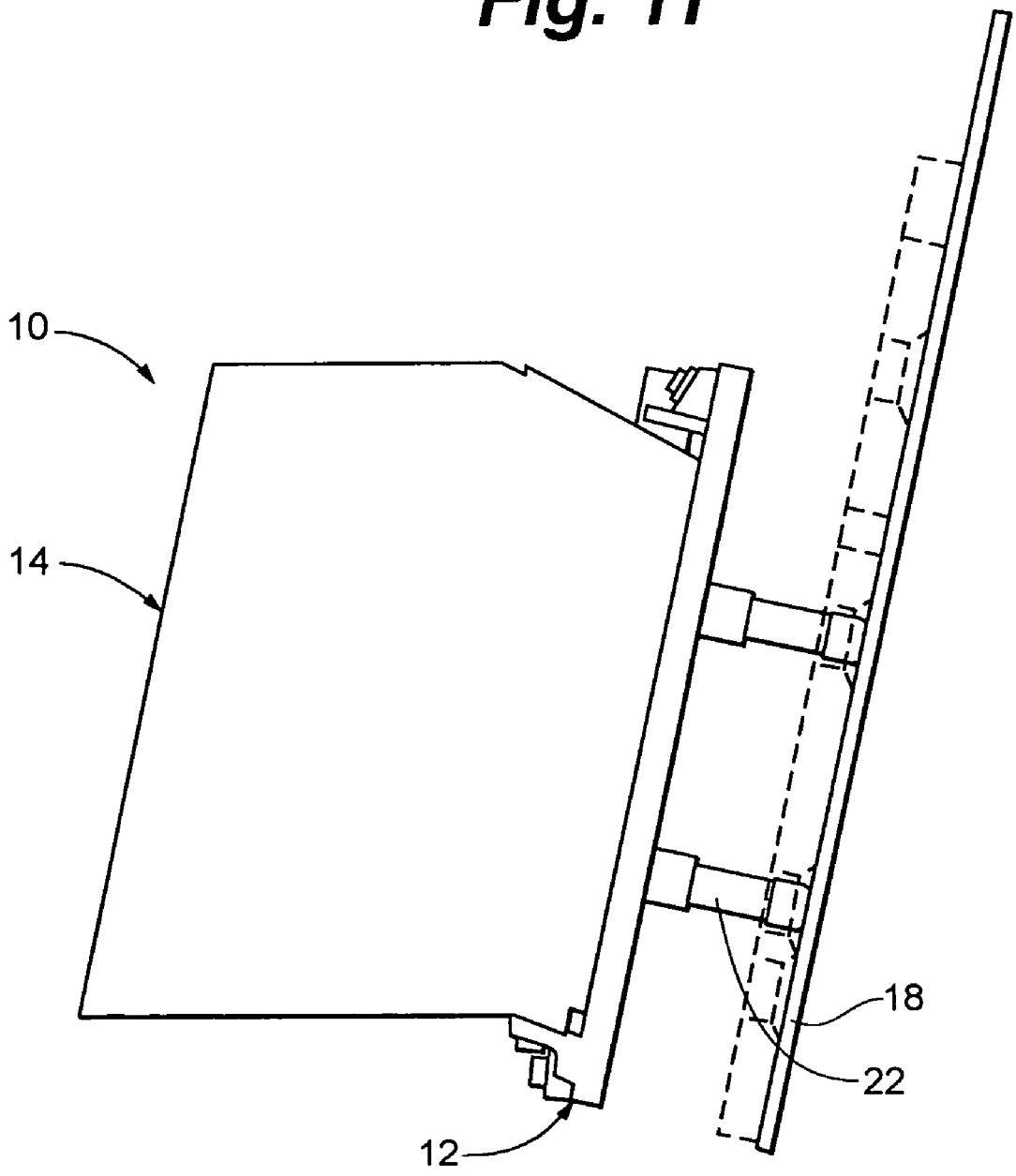
FIG. 11 is a side elevational view of the modular assembly of the present invention.

The subassembly of the modular assembly 10 that comprises the blast plate 12 includes plate structure 30. The blast plate 12 functions as an interface between the vehicle 16 and the modules 14. Plate structure 30 includes a first planar outer plate margin 32 and a second opposed planar inner plate margin 33. The plate structure 30 further includes a top margin 34 and a bottom margin 36. The structure 30 of the blast plate 12 may preferably be about 19.05 mm (0.75 inches) in thickness, as depicted in FIG. 11. Such thickness of the structure 30 by itself acts to deflect a blast directed at the hull 18.

A plurality of bores 38 are defined in the plate structure 30. The bores 38 are positioned in a selected pattern to match the known pattern of the array 20 disposed on the vehicle hull 18, such that the blind threaded bores 26 are in registry with the bores 38 when the blast plate 12 is positioned next to a specific known portion of the vehicle hull 18. The bores 38 may also be formed in a pattern conforming to the spaced apart bores 21 defined in parallel rails 20*b* of the alternative rail mounting array 20*a*. Accordingly, the pattern of bores 38 is dictated by the pattern of vehicle interfaces 20, 20*a* that are underlying the specific plate structure 30. The plate structure 30 may be uniquely shaped to mate to a specific portion of the specific vehicle 16 on which the plate structure 30 is to be mounted, while the modules 14 are standardized and may be moved from plate structure 30 to plate structure 30 and from vehicle 16 to vehicle 16, even where the vehicles 16 are of different types. It is understood that while the plate structure 30 is unique, a number of similar plate structures 30 may be employed on a vehicle 16, especially where the pattern vehicle interface array 20 underlying the specific plate structure 30 is the same, as on a planar portion of the hull 18 having repeatable patterns of the vehicle interface array 20.

Figure 3B:
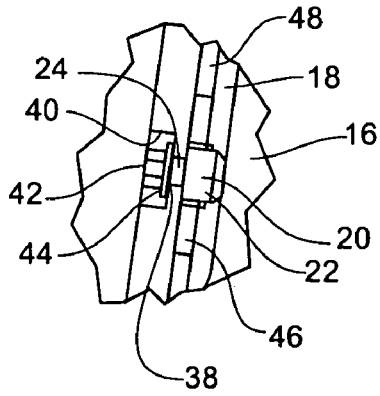
FIG. 3*b* is a side elevational view of FIG. 3*a* with an expanded depiction of the mounting of the blast plate subassembly to the vehicle hull.

As illustrated in FIGS. 2 and 3*b*, each of the bores 38 preferably has an expanded diameter recess 40 disposed proximate the outer plate margin 32. A bolt 42 and washer 44 is provided for each of the bores 38. The head of the bolt 42 and the washer 44 reside within the recess 40 when the bolt 42 is inserted into the bore 38. A spacing washer 36 is positioned over the vehicle interface 20 to provide a space 48 between the inner plate margin 33 and the exterior margin of the vehicle hull when the blast plate 12 is mounted to the vehicle hull 18. The spacing may preferably be about 69.342 mm (2.73 inches), as depicted in FIG. 11.

Mounting means 49 are fixedly disposed on the outer plate margin 32 and may comprise at least one L-shaped bracket 50. A first bracket 50 is preferably affixed to the outer plate margin 32 of the blast plate 12 proximate the bottom margin 36 of the plate structure 30. As depicted in FIG. 3*a*, additional rows of brackets 50 may be mounted to the plate structure 30 above the first bracket 50. Bracket mounting bores 56 are defined in a first side 52 of the bracket 50 so that bolts 58 may be passed therethrough and the bracket 50 thereby affixed to the plate structure 30. Other means of mounting the brackets 50 to the plate structure 30, including at least welding and bonding, are envisioned. The transverse side 54 of the bracket 50 includes a plurality of module mounting bores 60 defined therethrough.

The second subassembly of the modular assembly 10 is the module 14. As noted above, the module 14 may be reactive armor, passive armor, EM, or other types of modules. As depicted, the module 14 is a generally block-like module structure 62. The module 14 may preferably be about 272.034 mm (10.71 inches) in thickness, as depicted in FIG. 11.

Figure 4:
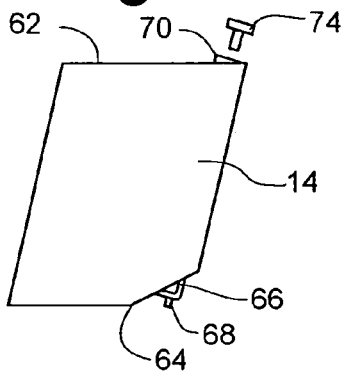
FIG. 4 is a side elevational view of the module subassembly.
Figure 5:
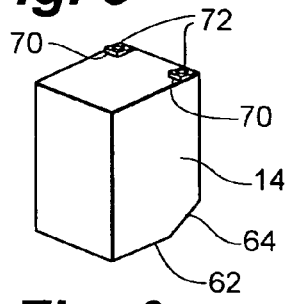
FIG. 5 is a perspective view of a module subassembly.
Figure 6:
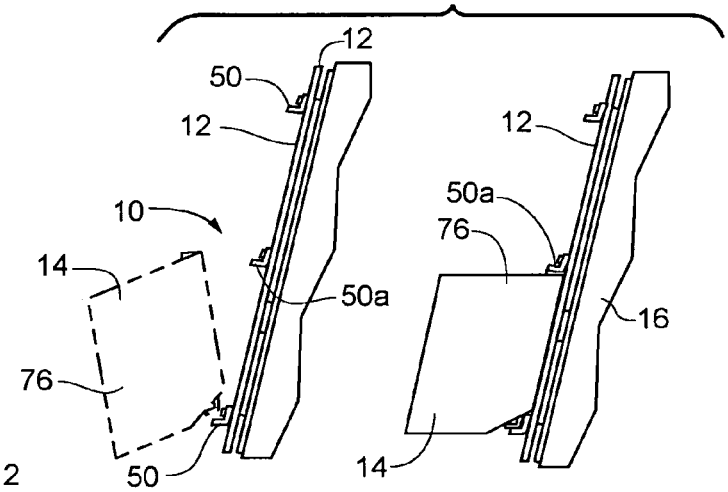
FIG. 6 is a side elevational view of the first (lower) row of modular subassemblies being mounted to a blast plate subassembly.

Preferably, a beveled corner 64 is formed by the module structure 62. As depicted in FIG. 4, an integral bracket 66 is coupled to the beveled corner 64 and preferably extends the full width of the module structure 62. The integral bracket 66 includes at least one depending integral pin 68. The beveled corner 64 preferably forms the inside lower corner of the module structure 62 when the module structure 62 is mounted to the blast plate 12.

A pair of spaced apart corner brackets 70 are disposed at the inside upper corner of the module structure 62 when the module structure 62 is mounted to the blast plate 12. Each of the corner brackets 70 has a bore 72 defined therein. Insertable pin 74 may be passed through a mounting bore 60 defined in the bracket 50 and into the bore 72. Alternatively, the insertable pin 74 could be a bolt and the bore 72 could be threaded. As depicted in FIGS. 6-9, a lower row 76 and an upper row 78 of modules 14 may be advantageously disposed on a single blast plate 12 mounted to the vehicle 16. More rows of modules 14 could be added as needed.

In assembly, the blast plate 12 is semi-permanently mounted to the vehicle 16 by the bolts 42 threadably engaging the blind threaded bore 26 of the vehicle interface 20. Once mounted on the vehicle 16, the blast plate 12 would not normally be removed during field operations, although removal is fairly easily accomplished by removing the bolts 42. Once conditions warrant, add-on modules 14 of various size and structure could be readily attached and readily removed from the blast plate 12, the blast plate 12 acting as an interface between the vehicle 16 and the modules 14. Such modules 14 may advantageously be of standard size and utilized on any vehicle or any type of vehicle to which the blast plate 12 has been affixed. The spacing of the brackets 50 mounted on the blast plate 12 is such that the spacing is standardized to accommodate the affixing of standard modules 14 thereto.

Figure 7:
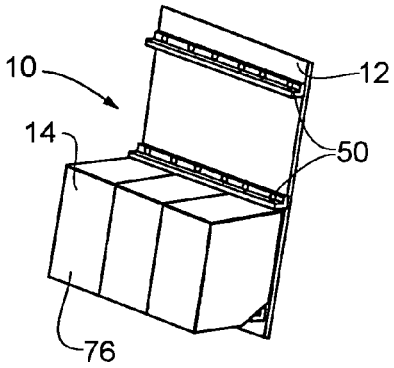
FIG. 7 is a perspective view of the first (lower) row of modular subassemblies mounted to the blast plate subassembly.

Mounting of the modules 14 to the blast plate 12 is depicted in FIGS. 6-9. The lower row 76 of modules 14 is mounted to the blast plate 12 by first engaging the integral pin 68 of the integral bracket 66 with a mounting bore 60 of the lower bracket 50 of blast plate 12. The individual module 14 is then rolled into place and the insertable pin 74 is passed through a bore 60 in the bracket 50*a* that is proximate the top margin of the module structure 62 and into the bore 72 defined in the corner bracket 70. In this manner, the individual module 14 is affixed both top and bottom to the blast plate 12. Further, the two brackets 50, 50*a* supporting the module 14 provide for electrical connection from the vehicle 16 to the module 14 as required by the EM modules and other needs and brackets 50 supporting adjacent modules 14 provide for electrical connection between the various modules 14 supported by a single bracket 50, 50*a*. Adjacent modules 14 comprising the lower row 76, as depicted in FIG. 7, provide for substantially zero gap between adjacent modules 14, thereby enhancing the protection to the vehicle 16.

Figure 8:
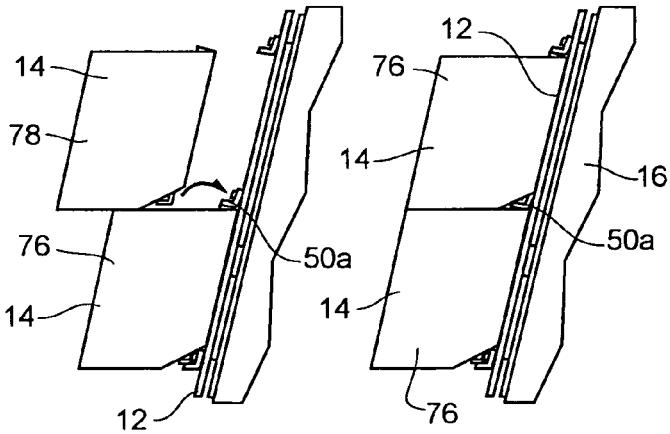
FIG. 8 is a side elevational view of the second (upper) row of modular subassemblies being mounted to the blast plate subassembly.
Figure 9:
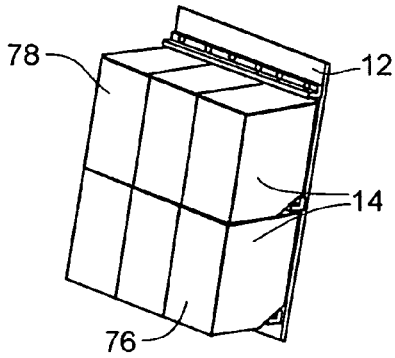
FIG. 9 is a perspective view of the upper and lower rows of modular subassemblies mounted to the blast plates of assembly.
Figure 10:
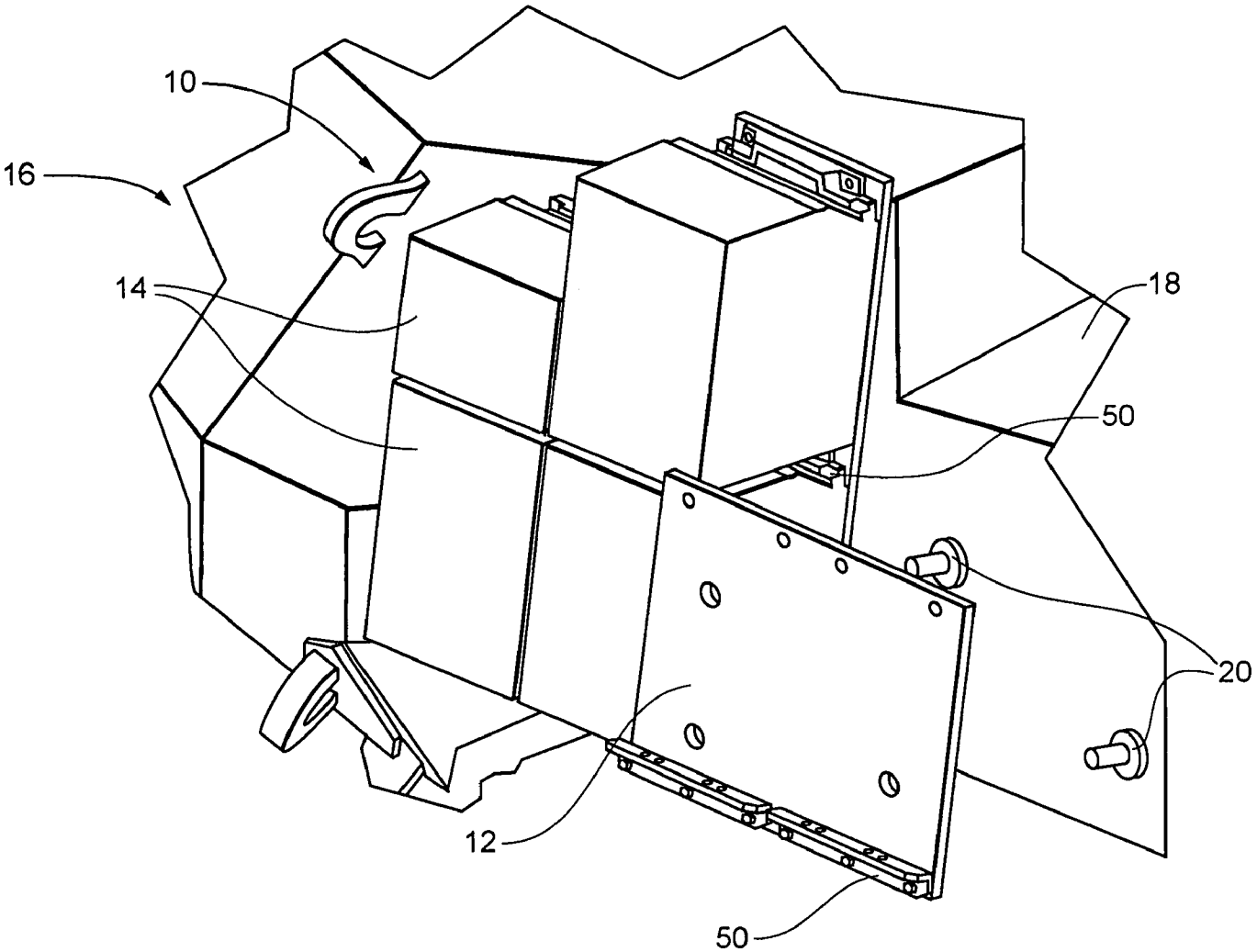
FIG. 10 is a perspective view of the modular assembly of the present invention.

Mounting of the upper row 78 of modules 14 is depicted in FIGS. 8 and 9. The same bracket 50*a* that supports the upper portion of the modules 14 comprising the lower row 76 acts to support the lower portion of the modules 14 comprising the upper row 78. Accordingly, the module 14 may be rested on the upper margin of the module 14 of the lower row 76 and slid into place with the depending integral pin 68 of the integral bracket 66 engaging one of the bores 60 of the bracket 50*a*. As noted above, since both the module 14 of the upper row 78 and the module 14 of the lower row 76 are supported on the same bracket 50*a* of FIGS. 6-9, there is an electrical connection between the module 14 of the lower row 76 and the module 14 of the upper row 78 that is positioned on top thereof. As noted in FIG. 9, when assembled with both a lower row 76 and an upper row 78 of modules 14, a substantially zero gap is defined between the various adjacent modules 14. Further, the mounting bracket 50*a* is protected from blast affects by being enclosed within the space defined between the beveled comers 64 of the upper module and the upper margin of the lower module 14.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A vehicle having a blast plate assembly, the vehicle having a hull, the hull having certain mounting devices for mounting certain structure exterior to the hull, comprising:

plate structure having blast deflecting properties and having a first planar margin and an opposed second planar margin, a plurality of mounting bores being defined in the plate structure, each of the bores being alignable with a selected mounting device on the hull;

at least one mounting bracket disposed on the first planar surface, the at least one mounting bracket having a plurality of bores defined therein for accepting a plurality of respective mounting pins of the at least one add-on device for supportively mounting the add-on device, the pins being readily removeable for readily demounting the add-on device; and attaching fixtures, a respective attaching fixture being disposable in each mounting bore and couplable to a respective mounting device for semi-permanently mounting the plate structure to the hull of the vehicle.

2. The blast plate assembly of claim 1 being mounted to the hull with a space being defined between the blast plate second planar margin and a hull exterior margin.

3. The blast plate assembly of claim 1 being mounted to the hull with a spacer being disposed between the blast plate second planar margin and a hull exterior margin to define a space therebetween.

4. The blast plate assembly of claim 3, the spacer being a plurality of washers, a respective washer being disposed circumferential to a respective mounting device.

5. The blast plate assembly of claim 1 the at least one mounting bracket being shielded in part by a portion of the add-on device that is supported by the bracket.

6. The blast plate assembly of claim 1, the add-on device having a top and a bottom, a top mounting bracket and a bottom mounting bracket supporting an add-on device both top and bottom.

7. The blast plate assembly of claim 1, a mounting bracket providing electrical connectivity to the add-on device.

8. The blast plate assembly of claim 1, a mounting bracket providing electrical connectivity between each of two add-on devices supported by the mounting bracket.

9. The blast plate assembly of claim 1, the plate structure being designed to be affixed to a certain portion of the hull structure and for supporting standardized add-on devices.

10. A vehicle interface, comprising:

a blast plate having plate structure, the plate structure being formed to substantially conform to a certain portion of an exterior margin of a hull of a certain vehicle and being semi-permanently mounted to the hull by mounting to certain mounting devices present on the exterior margin of the hull and having at least one mounting bracket for supportively mounting a standardized add-on device,the at least one mounting bracket having a plurality of bores defined therein for accepting a plurality of respective mounting pins of the add-on device for mounting the add-on device, the pins being readily removeable for readily demounting the add-on device, the plate structure having structural characteristics for acting to protect the hull from affects of a blast directed at the hull.

11. The interface of claim 10 being mounted to the hull with a space being defined between the blast plate and a hull exterior margin.

12. The interface of claim 10 being mounted to the hull with a spacer being disposed between the blast plate and a hull exterior margin to define a space therebetween.

13. The interface of claim 12, the spacer being a washer disposed circumferential to the respective mounting devices present on the exterior margin of the hull.

14. The interface of claim 10, the mounting bracket being shielded in part by a portion of the add-on device that is supported by the mounting bracket.

15. The interface of claim 10, the add-on device having a top and a bottom, the mounting brackets supporting an add-on device both top and bottom.

16. The interface of claim 10, the mounting bracket providing electrical connectivity to the add-on device.

17. The interface of claim 10, the mounting bracket providing electrical connectivity between two add-on devices supported by the mounting bracket.

18. A vehicle having a modular assembly, comprising:

a blast plate having plate structure, the plate structure being formed to substantially conform to a certain portion of a exterior margin of a hull of a certain vehicle and being semi-permanently mounted to the hull by being operably coupled to certain mounting devices present on the exterior margin of the hull;

at least one standardized add-on device module couplable to the plate structure; and the plate structure having at least one mounting bracket for supportively mounting the at least one standardized add-on device module,the at least one mounting bracket having a plurality of bores defined therein for accepting a plurality of respective mounting pins of the add-on device for mounting the add-on device module, the pins being readily removable for readily demounting the add-on device module, the plate structure having structural characteristics for acting to protect the hull from affects of a blast directed at the hull.

19. The modular assembly of claim 18 being mounted to the hull with a space being defined between the blast plate and a hull exterior margin.

20. The modular assembly of claim 18 being mounted to the hull with a spacer being disposed between the blast plate and a hull exterior margin to define a space therebetween.

21. The modular assembly of claim 20, the spacer being a washer disposed circumferential to the respective mounting devices.

22. The modular assembly of claim 18, the add-on device module having a top and a bottom, a top mounting bracket and a bottom mounting bracket supporting an add-on device module both top and bottom.

23. The modular assembly of claim 18, the mounting bracket providing electrical connectivity to the add-on device module.

24. The modular assembly of claim 18, the mounting bracket providing electrical connectivity between eaeh of two add-on device modules supported by the mounting bracket.

25. The modular assembly of claim 18, the add-on device module being an armor module.

26. The modular assembly of claim 25, the add-on device module being a reactive armor module.

27. The modular assembly of claim 25, the add-on device module being a passive armor module.

28. The modular assembly of claim 18, the add-on device module being an electromagnetic armor module.

* * * * *